US010847277B2

(12) United States Patent
Park

(10) Patent No.: US 10,847,277 B2
(45) Date of Patent: Nov. 24, 2020

(54) APPARATUS FOR REDUCING RADIOACTIVE NUCLEAR WASTE AND TOXIC WASTE VOLUME

(71) Applicant: PlasmaNano Corporation, La Jolla, CA (US)

(72) Inventor: Jaeyoung Park, La Jolla, CA (US)

(73) Assignee: PlasmaNano Corporation, La Jolla, CA (US)

( * ) Notice: Subject to any disclaimer, the term of this patent is extended or adjusted under 35 U.S.C. 154(b) by 787 days.

(21) Appl. No.: 15/721,030

(22) Filed: Sep. 29, 2017

(65) Prior Publication Data

US 2018/0096745 A1 Apr. 5, 2018

Related U.S. Application Data

(60) Provisional application No. 62/402,668, filed on Sep. 30, 2016.

(51) Int. Cl.

| | |
|---|---|
| ***G21F 9/30*** | (2006.01) |
| ***G21F 9/00*** | (2006.01) |
| ***G21F 9/28*** | (2006.01) |
| ***H05H 1/46*** | (2006.01) |

(52) U.S. Cl.

CPC ..... *G21F 9/30* (2013.01); *G21F 9/002* (2013.01); *G21F 9/28* (2013.01); *H05H 1/46* (2013.01); *H05H 2001/4667* (2013.01)

(58) Field of Classification Search

CPC ..... G21F 9/30; H05H 1/46; H05H 2001/4667
USPC ..... 588/1
See application file for complete search history.

(56) References Cited

U.S. PATENT DOCUMENTS

| | | | |
|---|---|---|---|
| 6,096,220 | A | 8/2000 | Ohkawa |
| 6,410,880 | B1 | 6/2002 | Putvinski et al. |
| 6,730,212 | B1 | 5/2004 | Yamagishi |
| 2007/0172601 | A1 | 7/2007 | Putvinski |
| 2014/0263181 | A1 | 9/2014 | Park |

OTHER PUBLICATIONS

The Double Well Mass Filter, Physics of Plasmas vol. 21, 020701 (2014)—(3 pgs).

*Primary Examiner* — Edward M Johnson

(57) ABSTRACT

Plasma reactors and methods are provided for reducing the volume of radioactive nuclear wastes or toxic wastes where the surface contamination is the main source of radioactivity or toxicity. The radioactive or toxic wastes are prepared in the form of small particles and fed into a pulsed plasma reactor operating in fluidized bed configuration. The repetitively pulsed radio-frequency (rf) powered plasma reactor generates high power plasma for pulse duration between 10 μs-10 ms. During the pulse, the plasma deliver a short burst of intense heat flux to the surface of waste feed particles. Due to the short pulse duration, the heat flux is concentrated on the surface without propagating much to the core of the particles. The localized heat flux preferentially removes the surface contaminants via vaporization. The removed waste in the vapor phase will be transferred out of the reactor where it may undergo additional treatments or disposed accordingly in a reduced volume. The residual particles which are free from surface contaminants can then be recycled or disposed as non-toxic or non-radioactive waste. By controlling the treatment time inside the plasma reactor along with the pulse power, duration and repetition rate, and the plasma chemical composition, the thickness of removed surface layers can be controlled to provide the efficient surface decontamination.

10 Claims, 7 Drawing Sheets

APPARATUS FOR REDUCING RADIOACTIVE NUCLEAR WASTE AND TOXIC WASTE VOLUME

FIELD

The disclosure pertains to apparatus and methods of separating radioactive and toxic materials from non-toxic base materials and in particular uses a pulsed plasma reactor to remove surface contaminants on the surface of solid waste. The system and device can function as a stand-alone waste treatment system or as a pre-treatment system for solid radioactive wastes generated from decommissioning of nuclear reactors in conjunction with plasma or gas mass separation system.

BACKGROUND

Significant amounts of nuclear wastes are being generated and in storage in the US and around the world from operating and/or decommissioning nuclear power plants. At present, low and intermediate level nuclear wastes, representing a majority of the total radioactive waste, are disposed of using surface or under-ground repositories that are safe for people and the environment for extended periods of time. While this disposal method is technologically sound, the cost of waste storage and potential leakage to the environment is significant. As such, there is a growing demand for a technology to reduce the volume of such nuclear wastes without creating an additional waste stream.

In recent years, a number of plasma based waste treatment solutions have been proposed. The key benefit of the plasma based waste treatment solution is the use of gaseous plasma medium instead of liquid chemical agents such as a sodium hydroxide (NaOH) containing solution. This allows the plasma treatment to reduce the waste volume without generating secondary waste. For example, the Archimedes Technology Group developed a physical process called "Plasma Mass Filter (PMF)", where radioactive wastes are separated from non-radioactive materials based on the atomic mass of each material element inside the rotating plasma. In addition, a magnetic centrifugal mass filter has been proposed by the researchers at Princeton University utilizing centrifugal and magnetic confinement of plasma in a cylindrical magnetic trap.

While both technologies present solutions to the need to separate radioactive wastes from non-radioactive materials without utilizing liquid chemical agents, both methods suffer the challenge related to vaporizing and producing plasma from a large amount of nuclear waste. In the case of Archimedes Technology Group, arc plasma injectors, plasma torch and high power lasers are utilized to vaporize the waste and forms the plasma before separating the waste into different atomic masses. All of these methods require a large amount of thermal energy inputs as the entire waste mass is vaporized.

However, there are significant amounts of waste where there is no need to vaporize the entire waste mass. For example, in the case of concrete and contaminated soils from the nuclear reactor sites, these wastes are in the form of solid containing only small fraction of radioactive waste on the surface, as shown in FIG. 1. In this case, a more efficient solution would be to remove the outermost surface layers without melting or vaporizing the bulk materials. One way to achieve this localized surface treatment is to use pulse plasmas to provide localized surface heating and vaporization using temporally modulated heat flux to the surface.

DETAILED DESCRIPTION OF ONE OR MORE EMBODIMENTS

Figure 3:
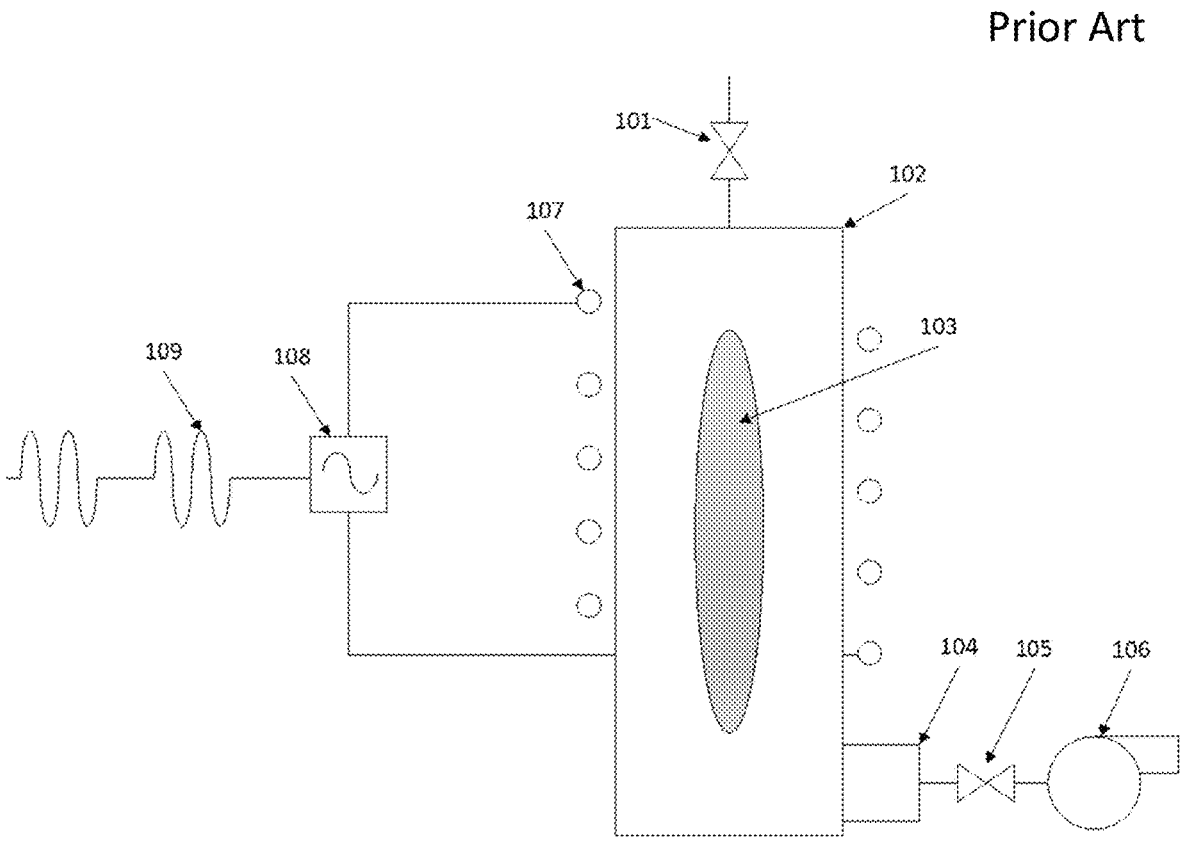
FIG. 3. A schematic of prior art pulsed plasma generator.

The disclosure is particularly applicable to a nuclear waste reduction system and method that uses pulsed plasma reactor to perform vaporization of a surface of the waste and it is in this context that the disclosure will be described. It will be appreciated; however, that the system and method has greater utility, such as to being used to reduce other types of radioactive or toxic wastes and may use other types of plasma reactors than those disclosed below. In one embodiment, the system and method may use a pulse plasma generator such as that disclosed in US patent application (US Patent Application US20140263181) as shown in FIG. 3.

Figure 1:
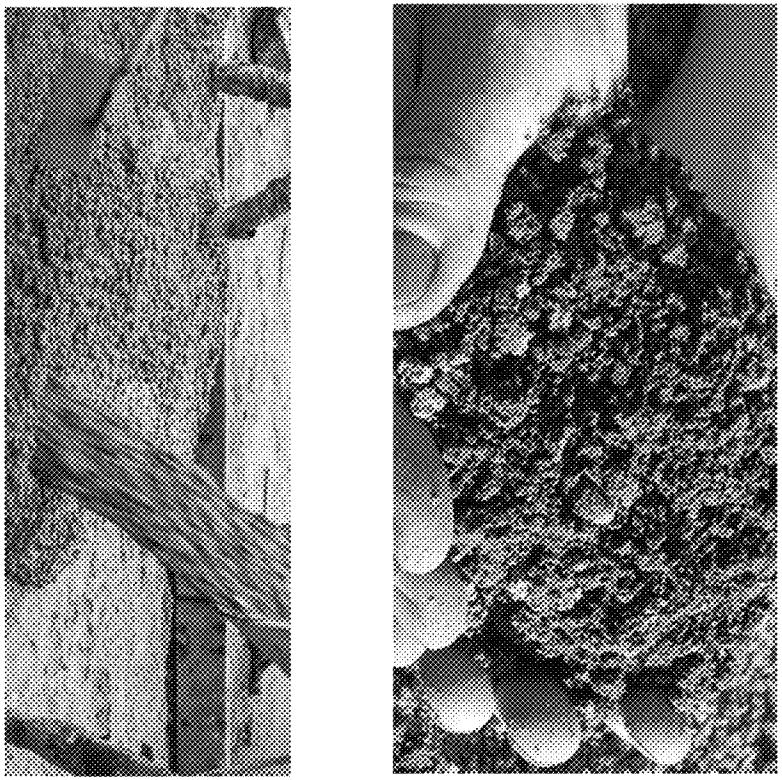
FIG. 1. Images of soils (top) and concretes (bottom).
Figure 2:
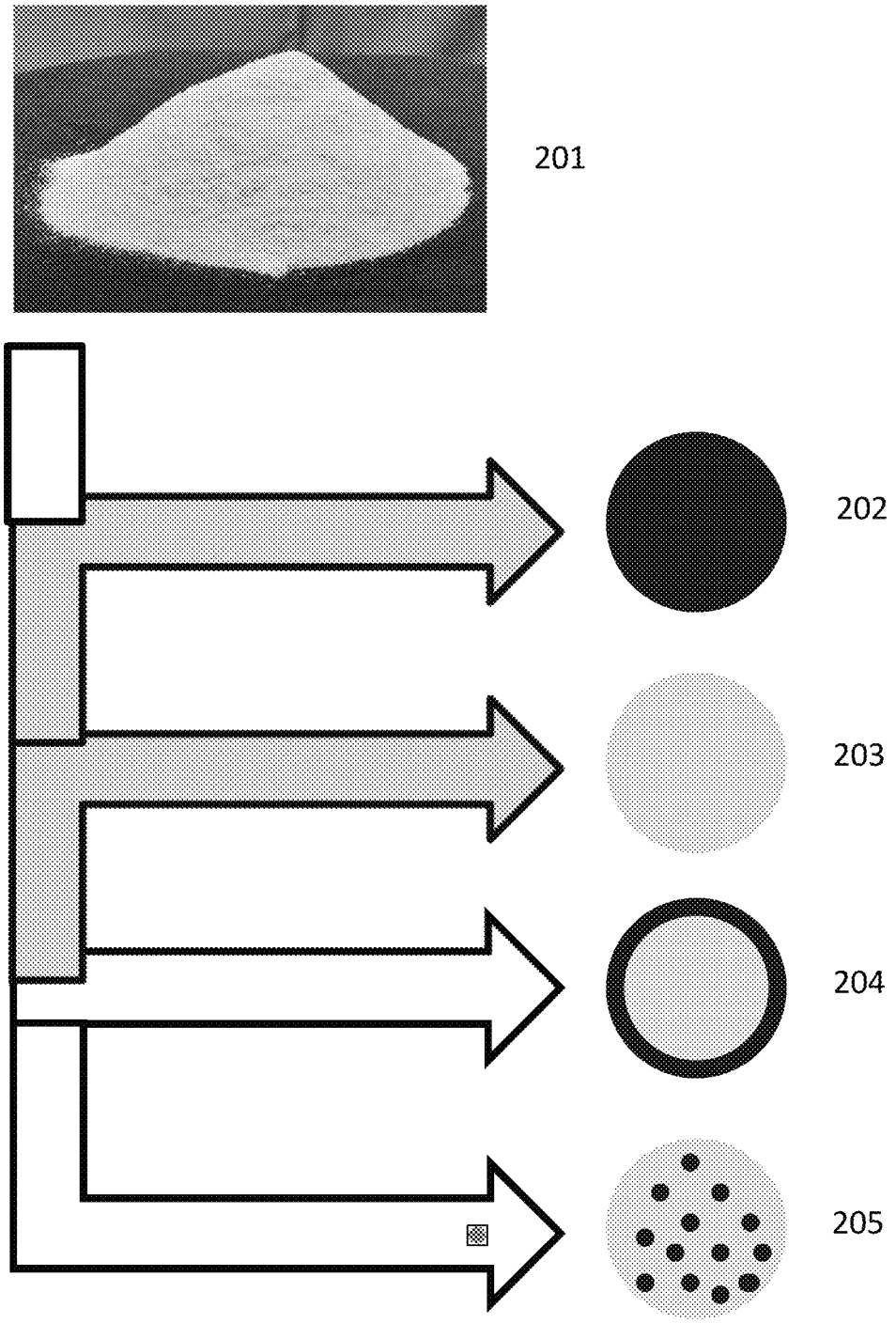
FIG. 2. Different types of solid waste particles. Black denotes radioactive or toxic materials and light gray denotes non-toxic recyclable materials.

In the disclosed method and prior to the plasma treatment, the solid wastes may be segregated by the particle size. Pulverization, grinding or milling can be used in connection with particle sieves to control the feed particle size. The desired range of the particle size is between 1 μm and 1 mm. FIG. 2 shows the solid waste feed prepared in the particle form 201 and different types of solid wastes. Here we consider four different types of particles from the solid waste as an example. The first is a solid particle largely consisting of radioactive nuclear materials or toxic materials 202. The second is a solid particle consisting of fully recyclable non-radioactive and non-toxic materials 203. The third is a solid particle of recyclable base materials with surface contaminants of radioactive nuclear materials or toxic materials 204. The last example is a solid particle of recyclable base materials with internal contaminants of radioactive nuclear materials or toxic materials 205.

Typically, the mass density of radioactive nuclear materials and toxic heavy metals are much heavier than the average mass density of rocks and soils. Here are the mass densities of typical radioactive nuclear materials and toxic heavy metals: 19.1 gram/$cm^3$ for Uranium, 19.8 gram/$cm^3$ for Plutonium, 19.4 gram/$cm^3$ for Neptunium, 13.7 gram/$cm^3$ for Americium, 13.6 gram/$cm^3$ for Mercury, and 11.3 gram/$cm^3$ for Lead. In comparison, the typical mass density of soil is only 2.6 gram/$cm^3$ and the mass density is 2.65 gram/$cm^3$ for silica or silicon dioxide, the most common constituent of sand. The big difference in particle mass density can be utilized to remove the particle type 202 from the rest of the waste feed using density based separation methods such as cyclonic particle separation.

Figure 4:
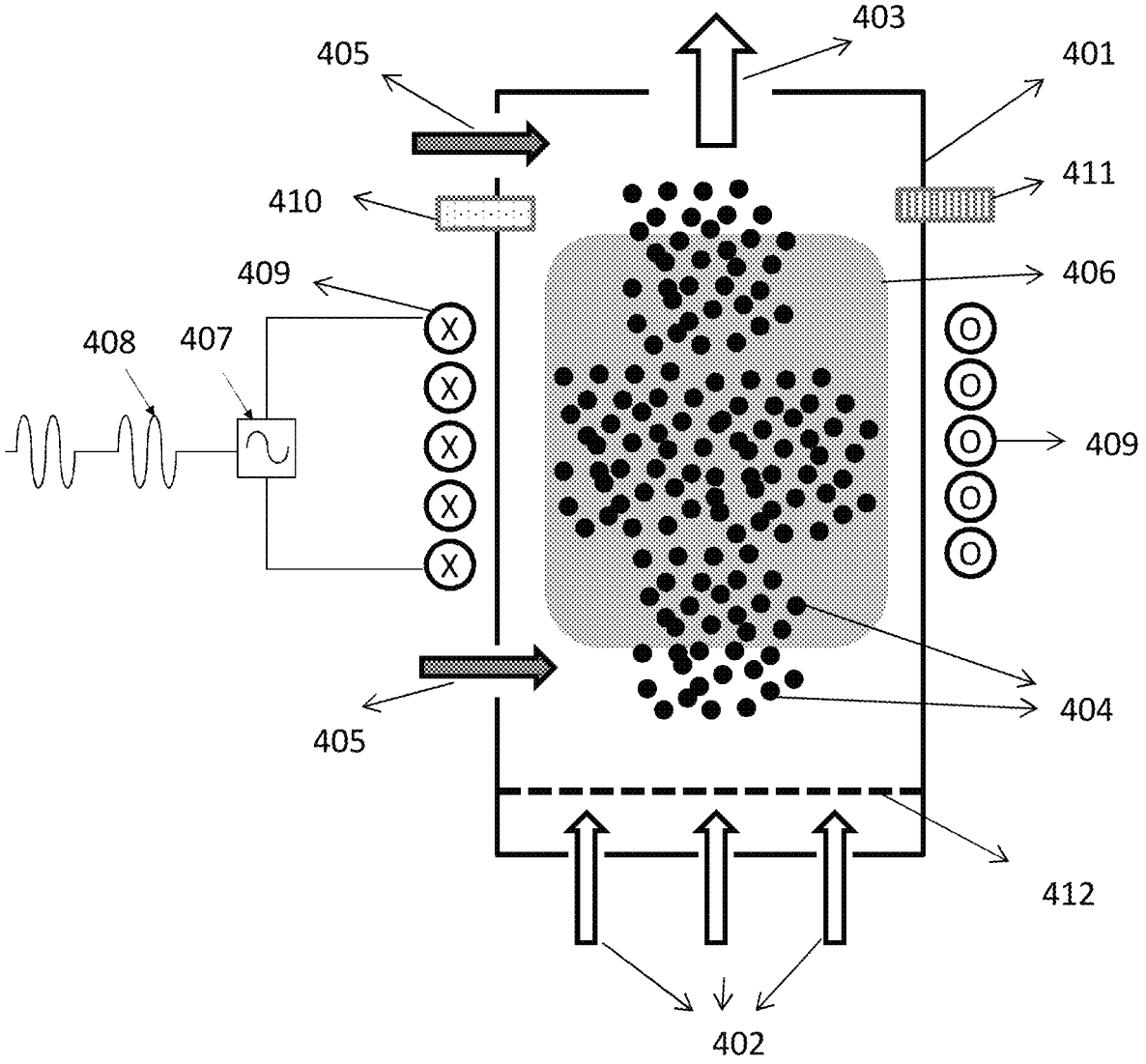
FIG. 4. A schematic of pulsed plasma reactor for surface decontamination for reducing radioactive nuclear waste and toxic waste volume.

Once the particle type 202 is removed from the rest of the waste feed, the remaining waste particles may be fed into a plasma reactor 400 for surface decontamination operating as shown in FIG. 4. FIG. 4 illustrates a preferred embodiment of the plasma decontamination reactor utilizing the previously described pulsed radio-frequency plasma generator. As shown in FIG. 3, the previously disclosed pulsed rf plasma generator operates with a gas inlet 101 and produces pulsed plasmas 103 inside a generator chamber 102. The plasma generator uses a pulsed radio frequency source 108 operating with a pulsed signal 109 that is coupled to an antenna 109. The generator operates with a pressurizing system 104 to maintain the gas pressure in the chamber. The pressuring system may further include a pump 106 and a valve 105 to control the gas pressure.

As shown in FIG. 4, a preferred embodiment of plasma decontamination reactor 400 has a reactor chamber 401 operating with gas inlets 402 and an exhaust system 403. The reactor may operate with chemically inert gases such as argon or chemically reactive gas such as tetrafluoromethane ($CF_4$) or the mixture of inert gas and reactive gas based on the waste particle properties and desired plasma treatments. Compared to liquid chemical agents, the use of reactive gases does not produce significant amounts of secondary wastes. By controlling the gas inlets and exhaust during operation of the reactor, the reactor will operate in a fluidized bed configuration where waste feed particles 404 are floated inside the reactor by the gas flow. The desired range of gas pressure in the reactor is between 1 torr and 1,000 torr. The waste particles 404 may be introduced by one or more particle feed systems 405 connected to the reactor chamber. Once the particles are fed into the plasma reactor, pulsed plasmas 406 will be generated by a pulsed rf source 407 operating with a pulsed signal 408 that is coupled to an antenna 409. The antenna may be water cooled or air cooled. An example of suitable plasma generators would be the previously disclosed PlasmaNano (PN) pulsed rf plasma generator shown in FIG. 3 and described above, though other plasma generators that can produce pulsed plasmas with a high pulse power and short pulse duration may also be used.

In the case of PN plasma generator shown in FIG. 4, the typical pulse duration is between 10 μs-10 ms and the rf power to the plasma is between 10 kW and 10 MW during the pulse while operating at gas pressures between 1 torr and 1000 torr. The use of high pulse power and short pulse plasma generators operating at these gas pressures is important.

At these gas pressures, even a modest reactor volume contains a large number of gas atoms and molecules that will get ionized and turned into a plasma. For example, in the case of argon gas pressures at 5 torr and at 50 torr, the corresponding gas number densities are $1.4\times10^{17}$ $cm^{-3}$ and $1.4\times10^{18}$ $cm^{-3}$. For a plasma reactor volume of 100 $cm^3$, the amounts of gas atoms in the reactor are $1.4\times10^{19}$ and $1.4\times10^{20}$ respectively. With the presence of these high number of gas atoms or molecules, it is then possible to couple a significant amount of radio frequency electrical energy to the waste particles via plasma generation. In comparison, many of the radio frequency inductive plasmas used at semiconductor materials processing operates from 1 mtorr to 50 mtorr pressure range with the corresponding gas density on the order of $3\times10^{13}$ $cm^{-3}$ to $1.5\times10^{15}$ $cm^{-3}$. Since there are not enough gas atoms and molecules in these reactors, it is typically not possible to generate significant heat flux to the waste particles at these low operating gas pressures.

The plasma generation at these gas pressures between 1 torr and 1000 torr involves significant heat generation in the plasma medium and subsequent heat transfer to surrounding structures, including but not limited to the antenna, an enclosure of the pulsed radio frequency generator, one or more walls of the reactor chamber, a substrate for surface treatment, nozzles in the inlet, a material collection system such as filter and collectors. By limiting the pulse duration of the plasma source operation between 10 μs and 10 ms, it is then possible to alleviate or eliminate cooling requirements to the affected surfaces, thus simplifying the engineering requirement and improving the reliability and overall power efficiency.

The use of short pulse duration requires high pulse power in order to generate high density plasma via which a significant amount of heat flux can be delivered to the particle surface. As discussed by Park [5], the typical energy budget of plasma generation is 100 eV-500 eV of energy cost for ionization of one pair of an electron and an ion from a gas atom where 1 eV equals to $1.6\times10^{-19}$ J. Assuming an energy budget of 150 eV, in order to ionize a 5% of gas in the reactor volume, an energy input from pulsed RF power system to the plasmas needs to be 17 J for the reactor volume of 100 $cm^3$ and a gas pressure of 5 torr, which results in the plasma density of $7\times10^{15}$ $cm^{-3}$. In the case of 50 torr gas operation, the amount of energy input needs to be 170 J for the reactor volume of 100 $cm^3$, which results in the plasma density of $7\times10^{16}$ $cm^{-3}$. For the pulse duration of 10 μs, the required pulse powers are 1.7 MW for 5 torr and 17 MW for 50 torr. For longer pulse duration of 1 ms, the required pulse powers are 17 kW for 5 torr and 170 kW for 50 torr. As such, high power coupling to the plasma during the pulse is needed for the radio frequency pulsed plasmas to be useful in the preferred embodiment.

If the plasma power during the pulse is too weak, the rate of vaporization will be too slow for practical uses. On the other hand, if the pulsed duration is too long, the surface heating from the plasma will propagate to the central region of the particles, leading to particle melting and mixing of radioactive nuclear waste with non-radioactive recyclable base materials. A preferred embodiment will utilize the localized surface heating and subsequent vaporization of radioactive from the particle surface using high pulse power and short pulse plasma generator such as the PN plasma generator.

During the pulse, the plasma electrons can transfer its energy to gas molecules via collisions, resulting in gas heating. While the collision frequency is high, the rate of energy transfer efficiency is low for each collision due to very large discrepancy in mass. The general expression for gas heating by plasma electrons is given as $dT_{gas}/dt \sim n_e\langle\sigma\upsilon\rangle T_e(m_e/m_{gas})$, where $T_{gas}$ the gas temperature, $n_e$ is the electron density in the plasma, $\sigma$ is the electron gas collision cross section, $\upsilon$ is the electron velocity, $T_e$ is the electron temperature and $m_e/m_{gas}$ is the mass ratio between electron and gas atoms. In the case of argon operating at 10 torr, the plasma electron density is $1.4\times10^{16}$ $cm^{-3}$, assuming a 5% ionization fraction. The plasma density can be controlled by the radio frequency (rf) pulse input power, while the average electron temperature is between 5 and 10 eV in a wide range of input powers, based on the experimental and theoretical database of rf thermal plasmas in steady state. It is noted that the plasmas establish its density and temperature equilibrium for a given rf input power in a very short time, typically within a few μs due to the rapid response of electrons to the applied rf electric fields. We will use 5 eV electron in this example, resulting in electron thermal velocity of $9.4\times10^7$ cm/s and electron temperature of 57,000 Kelvin. At 5 eV, electron-gas collision cross section is approximately $1\times10^{-15}$ $cm^2$ for argon gas. By putting the above numbers in the gas heating expression, $dT_{gas}/dt$ is $1\times10^8$ Kelvin/s or 100 Kelvin/μs. This result shows that the gas temperature in the pulsed plasma reactor will gradually increase over the pulse duration by electron gas heating. For a fixed plasma density of $1.4\times10^{16}$ $cm^{-3}$, the gas temperature will rise to 500 C, (from 20 C inlet temperature) for 5 μs pulse duration and to 1,000 C for 10 μs pulse duration, in this simplified estimate. Thus, the pulse duration control provides a powerful yet convenient method to adjust the reactor gas temperature, especially for pulse duration between 10 μs and 10 ms. Since the gas temperature is one of the critical parameters to determine the heat flux to the waste particles, this results provide the basis for the surface waste contaminants removal rate of the pulse plasmas. It is noted that we have ignored the energy loss mechanism by gas via conduction, convection and radiation, so the temperature rise will be less than this value and the gas temperature will likely saturate between 5,000 C and 10,000 C. It is also noted that the gas heating rate can be controlled by plasma density or rf pulse power.

It is noted that the pulse plasma reactor only generates a small amount heat during the pulse operation. This is because the heat capacity of the gas is very small, 12.6 J/(mole×Kelvin). Since the pulse plasmas heat only a small amount of gas molecules, $2.3\times10^{-5}$ mole of argon gas for 100 $cm^3$ reactor volume at 5 torr, the total amount of heat from the high temperature gas is relatively small. Even at 5,000 C, the argon gas in the pulsed reactor will only contain 1.5 J of energy at the above condition. Even at very high repetition rate of 1 kHz, the total gas heating results in 1.5 kW, equivalent to a household hair dryer. This is because of the short pulse nature of pulsed radio frequency plasma operation. By limiting heat generation during the pulse, it is then possible to utility modest amount of electrical power to remove the surface contaminants of radioactive and toxic materials. In addition, the pulsed localized heating on the particle surface can accelerate the surface chemical reactions to speed up the vaporization of waste material when used with the chemically reactive precursors containing hydrogen, oxygen, chlorine, and fluorine.

Here we discuss a set of preferred operating conditions for the plasma decontamination reactor using a PN plasma generator operating with 200 kW rf power and 200 μs pulse duration is set forth below. For a feed particle size of 100 μm diameter, the surface area of each particle is $3.14\times10^{-4}$ $cm^2$ and the volume of the particle is $5.24\times10^{-7}$ $cm^3$. By controlling the particle feed rate and the gas flow in the fluidized bed configuration, the reactor may operate with 5 grams of waste feed particles inside the reactor, corresponds to treating 3.7 million particles. Due to a small particle size, the total surface area of the 3.7 million particles is $1.1\times10^3$ $cm^2$, comparable to or exceeding the reactor chamber surface area. As such, a significant fraction of the rf power to the plasma will be deposited to the particle surface during the pulse. Assuming 30% of rf power to the plasma is deposited to the particle surface, the plasma delivers $3.3\times10^{-6}$ Joule (J) of heat flux to each particle surface during 200 μs pulse. This corresponds to 520 kW per square meter of pulsed heat flux to the particle surface. In comparison, the average solar radiation to the Earth's surface is 340 W per square meter.

At typical plasma temperatures of 10,000 Kelvin to 100,000 Kelvin, the electrons and ions of the plasma do not penetrate deep into the particle surface. Instead, the plasma deposits most of its energy to a very thin surface layer, typically on the order of 10 to 100 atomic layers. In the case of Americium, an example of a radioactive nuclear material of interest, the surface thickness of 50 atomic layers is 8.7 nm based on its average atomic layer of 0.17 nm. Using the mass density of Americium at 13.7 gram/$cm^3$ and the specific heat capacity of 62.7 J per mole per Kelvin, the heat pulse of $3.3\times10^{-6}$ J will increase the temperature of the 50 Americium atomic layers by 3400 degrees in Kelvin during the pulse. In comparison, the boiling point of Americium is only 2,880 Kelvin. While this simple estimate ignores the thermal diffusion, it illustrates the capability of pulsed plasma to deposit a significant amount of heat to the particle surface layer and to vaporize radioactive nuclear waste such as Americium from the surface of feed particles.

Figure 5:
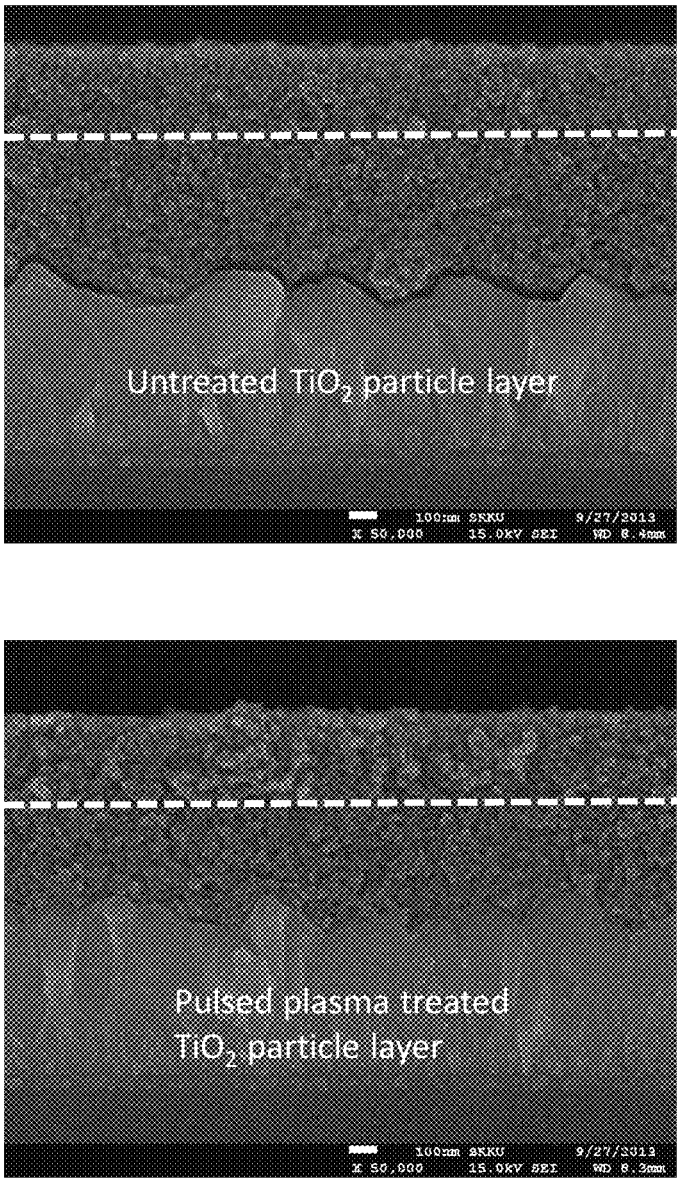
FIG. 5. Scanning electron microscope (SEM) images of titanium dioxide ($TiO_2$) nanoparticle layers deposited on to the glass substrate for untreated $TiO_2$ nanoparticles (top) and pulsed plasma treated $TiO_2$ nanoparticles (bottom).

FIG. 5 shows scanning electron microscope (SEM) images of titanium dioxide ($TiO_2$) nanoparticle layers deposited on to the glass substrate. The top image is for untreated $TiO_2$ nanoparticles and the bottom image is for pulsed plasma treated $TiO_2$ nanoparticles. In this case, the plasma treatment was performed to provide change in particle surface morphology to improve their solar energy conversion efficiency rather than to vaporize the particles. To highlight the impact of the plasma treatment, dotted white lines are shown on each image at 25 nm depth from surface. The SEM images show marked difference in shape and texture between the plasma treated sample and untreated sample, demonstrating the effectiveness of surface treatment by the pulsed plasma.

While the amount of removed surface layers may be small for each pulse, a sufficient rate of surface removal can be obtained by utilizing many pulses with a high repetition rate of the pulse. Operating at a pulse repetition rate of 50 Hz, the average power consumption for the PN plasma generator is 2 kW at 200 kW rf pulse power with 200 μs pulse duration. In the case of surface contaminations covering 1 μm of surface layers or 5,800 atomic layers of radioactive Americium on the particle surface, the pulsed plasma can provide a waste treatment throughput of 0.9 kG per hour, if each pulse can remove 1 nm of surface layers operating with 5 grams of waste particle in the reactor. In addition, the pulsed plasma reactor can control the thickness of removed surface layer by varying the treatment time of the waste particles inside the plasma reactor along with the pulse power, duration and repetition rate.

Figure 6:
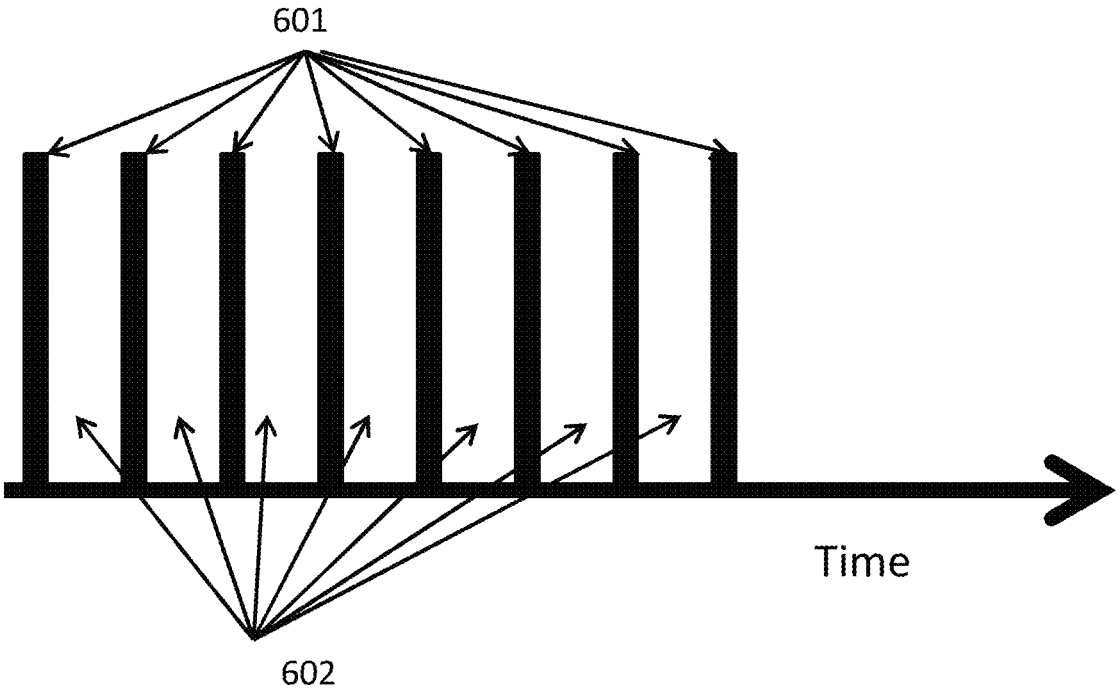
FIG. 6. A temporal waveform of pulse plasma operation.

In addition, unlike the continuously operating plasma reactors, the pulsed plasma reactor provides time windows when the electrical noise from the plasma is greatly suppressed as shown in FIG. 6. The on time of the plasma pulse is shown as black bars 601 in FIG. 6. During the off-time of the pulse 602, the electrons and ions in the plasma quickly recombine or are lost to the wall, leaving the reactor environment free from plasma electrical noises. Real time high fidelity in-situ measurements can be made during the off-time. Various radiation detectors 410 such as high energy particle detectors for alpha and beta emitting radioactive waste or gas species detectors 411 shown in FIG. 4 can be used to monitor the real-time radioactivity or toxicity of the treated waste.

Figure 7:
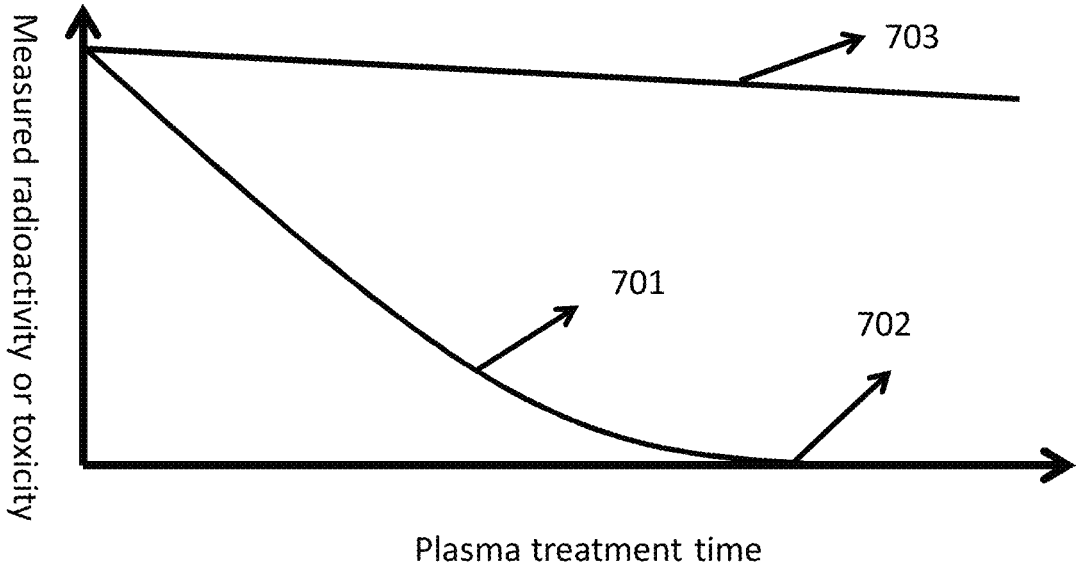
FIG. 7. Temporal waveforms of radioactivity or toxicity of plasma treated waste and a treatment end point.

The data from the in-situ measurements can be used to optimize the treatment efficiency as well to provide the end-point of plasma treatment, as shown in FIG. 7. In the case of waste containing particle types 203 and 204 shown in FIG. 2 and described above, the plasma treatment may remove the surface contaminants and the radioactivity of the treated waste will decrease as a function of plasma treatment time 701. In this case, the efficiency of plasma treatment can be measured in real time and the end point of the treatment can be determined using a preset radioactivity level 702. On the other hand, if the waste particles are largely made of the particle type 205, the plasma treatment will not be effective in removing radioactive materials and the measurement will result in a minimal decrease in radioactivity 703. An example of such wastes is neutron or gamma ray activated structure materials in close vicinity of the nuclear reactor. In this case, the data from the in-situ measurement can be used to stop the plasma treatment and to separate such waste feed from the other types of waste for different treatments such as a plasma mass filter using arc or laser vaporization of entire particles.

One of the challenges of the plasma reactor is the damage and contamination of the electrodes in contact with the plasma. In addition, with the use of particles in the reactor, frequent arcing can occurs on the surface electrodes contributing to the electrode damage. Also, the use of reactive gas species in the plasma can create complications regarding the compatibility of electrode materials. However, by using rf power between 50 kHz and 10 MHz with externally placed antenna, the inductive plasma generation by the PN plasma generator addresses these challenges.

The plasma treatment in the preferred embodiment will generate two products from the feed waste particles: the removed surface wastes in the vapor phase and the residual particles free from surface contamination. After the plasma treatment, the removed wastes in the vapor phase contain most, if not all, of the surface radioactive or toxic materials, while their total mass is much smaller than the initial waste particle feed. This can be achieved by the use of in-situ monitoring and end-point detection or pre-programmed plasma treatment process. Since they are in the vapor form, the removed waste can be easily transferred out of the reactor volume into the collector via a waste exhaust 403 as shown in FIG. 4. The generation of concentrated radioactive waste in the removed vapor phase is the key principle of the volume reduction by the pulsed plasma surface treatment. The removed waste can then undergo additional treatments such as a plasma mass filter where the further separation of radioactive or toxic waste is achieved. Since the waste is already in the vapor phase with greatly reduced input power, the pulsed plasma surface treatment can greatly enhance the overall power efficiency of plasma mass filters. Alternatively, the removed waste can be disposed accordingly at a small volume once the evaporated waste materials solidify in the collector and are separated from the working gas of the reactor.

After the plasma treatment, the residual particles will contain little or no radioactive materials, while the total mass of the residual particles is comparable to the feed particles. The residual particles can be collected from the plasma reactor using various methods. By temporarily stopping the gas flow, the residual particles can fall down to the bottom of the reactor by gravity with the appropriate collectors such as particle filter 412 and can be removed from the reactor, if their mass is sufficiently heavy. For small particles where the gravitational force is weak, the filter can also be used to capture them as they are removed from the plasma reactor by generating the air flow toward the particle. In the case of the plasma reactor in FIG. 4, this can be achieved by reversing the gas flow direction at the inlet 402, while closing down the waste exhaust 403. Once removed from the plasma reactor, they will be recycled or disposed as non-radioactive waste or lower level radioactive waste depending on their waste level. It is noted that the particle feeding, waste exhaust and residual particle collecting system can operate intermittently using a batch feed system or continuously with a continuous feed system with appropriate valves and switches.

The foregoing description, for purpose of explanation, has been described with reference to specific embodiments. However, the illustrative discussions above are not intended to be exhaustive or to limit the disclosure to the precise forms disclosed. Many modifications and variations are possible in view of the above teachings. The embodiments were chosen and described in order to best explain the principles of the disclosure and its practical applications, to thereby enable others skilled in the art to best utilize the disclosure and various embodiments with various modifications as are suited to the particular use contemplated.

The invention claimed is:

1. An apparatus, comprising:

a pulsed radio frequency source that is driven with a pulse duration and generates radio frequency signal;

a decontamination reactor where a pulsed plasma is generated by the pulsed radio frequency source that removes surface contaminants of radioactive and toxic materials from a plurality of waste feed particles and leaves residual particles, the pulsed plasma delivering intense pulsed heat flux to a surface of the plurality of waste feed particles to vaporize the surface radioactive and toxic materials into volatile gas species;

an inductive antenna, coupled to the pulsed radio frequency source, that surrounds a portion of the decontamination reactor and delivers radio frequency power to the pulsed plasma and generates the pulsed plasma;

a particle feed system that injects the plurality of waste feed particles into the decontamination reactor;

a particle flow system, within the decontamination reactor, that controls the plurality of waste feed particles motion and mixes the plurality of waste feed particles with the pulsed plasma in the decontamination reactor;

an exhaust through which the vaporized radioactive and toxic materials are transferred out of the decontamination reactor; and a particle collection system that collects the residual particles after the plasma treatment.

2. The apparatus of claim 1, wherein the pulse duration is between 10 μs and 10 ms.

3. The apparatus of claim 1, wherein the radio frequency is between 50 kHz and 10 MHz.

4. The apparatus of claim 1, wherein the pulsed radio frequency source has a repetition rate from 1 Hz to 1 kHz.

5. The apparatus of claim 1, wherein the radio frequency power to the plasma is between 10 kW and 10 MW during the pulse.

6. The apparatus of claim 1, wherein the operating pressure inside the decontamination reactor is between 1 torr and 1000 torr.

7. The apparatus of claim 1, wherein a diameter of the plurality of waste feed particles is between 1 μm and 1 mm.

8. An apparatus, comprising:

a pulsed radio frequency source that is driven with a pulse duration and generates a radio frequency signal;

a decontamination reactor where a pulsed plasma is generated by the pulsed radio frequency source that removes surface contaminants of radioactive and toxic materials from a plurality of waste feed particles and leaves residual particles, the pulsed plasma delivering intense pulsed heat flux to a surface of the plurality of waste feed particles to vaporize the surface radioactive and toxic materials into volatile gas species;

an inductive antenna, coupled to the pulsed radio frequency source, that surrounds a portion of the decontamination reactor and delivers radio frequency power to the pulsed plasma and generates the pulsed plasma;

a particle feed system that injects the plurality of waste feed particles into the decontamination reactor;

a particle flow system, within the decontamination reactor, that controls the plurality of waste feed particles motion and mixes the plurality of waste feed particles with the pulsed plasma in the decontamination reactor;

an exhaust through which the vaporized radioactive and toxic materials are transferred out of the decontamination reactor;

a particle collection system that collects the residual particles after the plasma treatment; and an in-situ diagnostics system to monitor removal of radioactive waste and toxic waste during plasma treatment, wherein the in-situ diagnostics system monitors residual radioactivity and toxicity of the plurality of waste feed particles during the off-time of the radio frequency power to the pulsed plasma and determines the end point of plasma treatment.

9. The apparatus of claim 8, wherein the in-situ diagnostics system is an alpha or beta or gamma radiation detector to monitor the residual radioactivity of the waste feed particles.

10. The apparatus of claim 8, wherein the in-situ diagnostics system is gas mass spectrometer or residual gas analyzer.

* * * * *